US005249977A

United States Patent [19]

Tanaka et al.

[11] Patent Number: 5,249,977

[45] Date of Patent: Oct. 5, 1993

[54] ELECTRICAL CONNECTOR ASSEMBLY FOR POSITIONING ON A CIRCUIT BOARD BY A SUCTION APPLYING TOOL

[75] Inventors: Mitsuho Tanaka; Masakazu Koiso, both of Tokyo; Koichi Asai, Aichi; Mitsuo Morishita, Aichi; Kazuhiko Yokomae, Aichi, all of Japan

[73] Assignee: KEL Corporation, Tokyo, Japan

[21] Appl. No.: 914,778

[22] Filed: Jul. 15, 1992

[30] Foreign Application Priority Data

Jul. 15. 1991 [JP] Japan ..... 3-063052[U]

[51] Int. Cl.[5] ..... H01R 13/44

[52] U.S. Cl. ..... 439/135; 439/476; 439/83

[58] Field of Search ..... 439/68, 70, 71, 72, 439/73, 78, 83, 55, 931, 135, 149, 83, 476

[56] References Cited

U.S. PATENT DOCUMENTS 4,396,245 8/1983 Lane ..... 439/148
4,541,538 9/1985 Swetnam ..... 439/135 X
5,147,209 9/1992 Litwin et al. ..... 439/71 X

FOREIGN PATENT DOCUMENTS 5733730 3/1983 Japan .

*Primary Examiner*—Larry I. Schwartz
*Assistant Examiner*—Khiem Nguyen
*Attorney, Agent, or Firm*—Robert W. J. Usher

[57] ABSTRACT

A disk-shape portion of a surface mount connector housing or a separate cap member provides an upwardly facing surface adherable by suction to a suction nozzle of a conventional, automatic, vacuum type pick-and- place assembly tool and are, respectively, either integrally joined to the connector at the mating face. by a frangible or severable portion, or releasably attached to the connector housing by resilient legs which grip the housing between them, enabling the connector to be carried into position on a circuit board by the tool.

3 Claims, 4 Drawing Sheets

ELECTRICAL CONNECTOR ASSEMBLY FOR POSITIONING ON A CIRCUIT BOARD BY A SUCTION APPLYING TOOL

FIELD OF THE INVENTION

The invention relates to an electrical connector assembly for positioning on a circuit board by a conventional, suction applying tool and to cap member defining a surface adherable by suction for releasable attachment to the connector assembly to enable the connector to be transported by carrying into position on the circuit board by the suction tool.

BACKGROUND OF THE INVENTION

It is known to use automatically operated, suction or vacuum type, pick-and-place, tools to carry surface mounted electrical components such as integrated circuits or capacitors into position on a circuit board.

Whereas such components inherently have flat parts operably engagable in covering relation with the suction nozzle mouth of the tool so as to adhere by suction thereto, as surface mount type electrical connectors usually comprise insulating bodies with thin upstanding walls defining elongate, upwardly opening cavities at a mating face and which extending beyond the periphery of a nozzle mouth, an upwardly facing surface, suitably flat and extensive for adherence by suction is not available, preventing use of automatic handling by vacuum type equipment.

U.S. Pat. No. 4,396,245 issued Aug. 2, 1983 to Lane discloses an electrical connector having a cover member completely closing a mating cavity for retaining contacts in a housing prior to receipt in apertures in a circuit board, preventing ingress of dust and other contaminants into the connector and for providing a force transmitting surface for engagement by an insertion tool.

SUMMARY OF THE INVENTION

It is an object of the invention to provide or adapt a matable electrical connector assembly of the type having an elongate mating cavity opening to a mating face for carrying into position on a circuit board by a vacuum-type tool.

An additional object of the invention is to provide a connector portion or cap member defining an upwardly facing surface adherable by suction and integrally joined to the connector at the mating face, by a frangible or severable portion, or releasably attachable to the connector housing.

According to one aspect of the invention there is provided an electrical connector assembly for carrying into position on a circuit board by a conventional, suction applying tool comprising an insulating housing having a lower, circuit board engaging face and an upper, mating face, an elongate mating cavity opening to the mating face and being greater in length than a corresponding dimension of a mouth of a suction nozzle of the tool, means defining a surface engageable in covering relation with the nozzle mouth for adherence thereto by suction and having a length less than the length of the cavity opening and means for releasably attaching the adherable surface means to the connector to extend across the mating face thereof with portions of the cavity opening to the mating face on each side of the adherable surface means.

Preferably, the attaching means comprises resilient means depending from the adherable surface into the cavity and resiliently engaging the side walls.

This construction enables the provision of the adherable surface as a completely separate cap member which may be molded from one piece of plastic material economically by mass production techniques and attached and detached from the connector by a simple pressing or pushing action performed automatically by a simple assembly tool. The resilient means are preferably a pair of resilient legs depending form the adherable surface portion and releasably gripping the outside of the housing obviating risk of destructive engagement with contacts retained inside the housing.

Alternatively, the attaching means comprises severable means joining the adherable surface means to the housing at the mating face.

This construction avoids a requirement for a separate part reducing inventory, while avoiding need for other connector modification, such as change of contact pitch.

According to another aspect of the invention, there is provided a method of mounting an electrical connector of the surface mount type on a circuit board using a pick and place apparatus of the suction type, the connector having an insulating housing with a board engaging face and an opposite, mating face defined by at least one wall portion of less dimension than a suction nozzle mouth of the apparatus so as to the non-adherable thereto, the method comprising the steps of providing a one-piece cap member comprising surface means adherable by suction to the suction nozzle and resilient attachment means extending from the surface means and releasably enagagable with the housing in a push fit push fitting the cap member onto the housing at a location remote from the circuit board so that the surface means extends across the face thereof operatively engaging the suction nozzle of the apparatus with the adherable surface of the cap member so as to be adhered by suction thereto and carrying the connector thereby into position on the circuit board reflow soldering the connector to the circuit board releasing the suction nozzle from the cap member; and, releasing and removing the cap member from the connector housing.

BRIEF INTRODUCTION TO THE DRAWINGS

Embodiments of the invention will now be described, by way of example only, and with reference to the accompanying drawings in which.

DESCRIPTION OF PARTICULAR EMBODIMENTS

Figure 1:
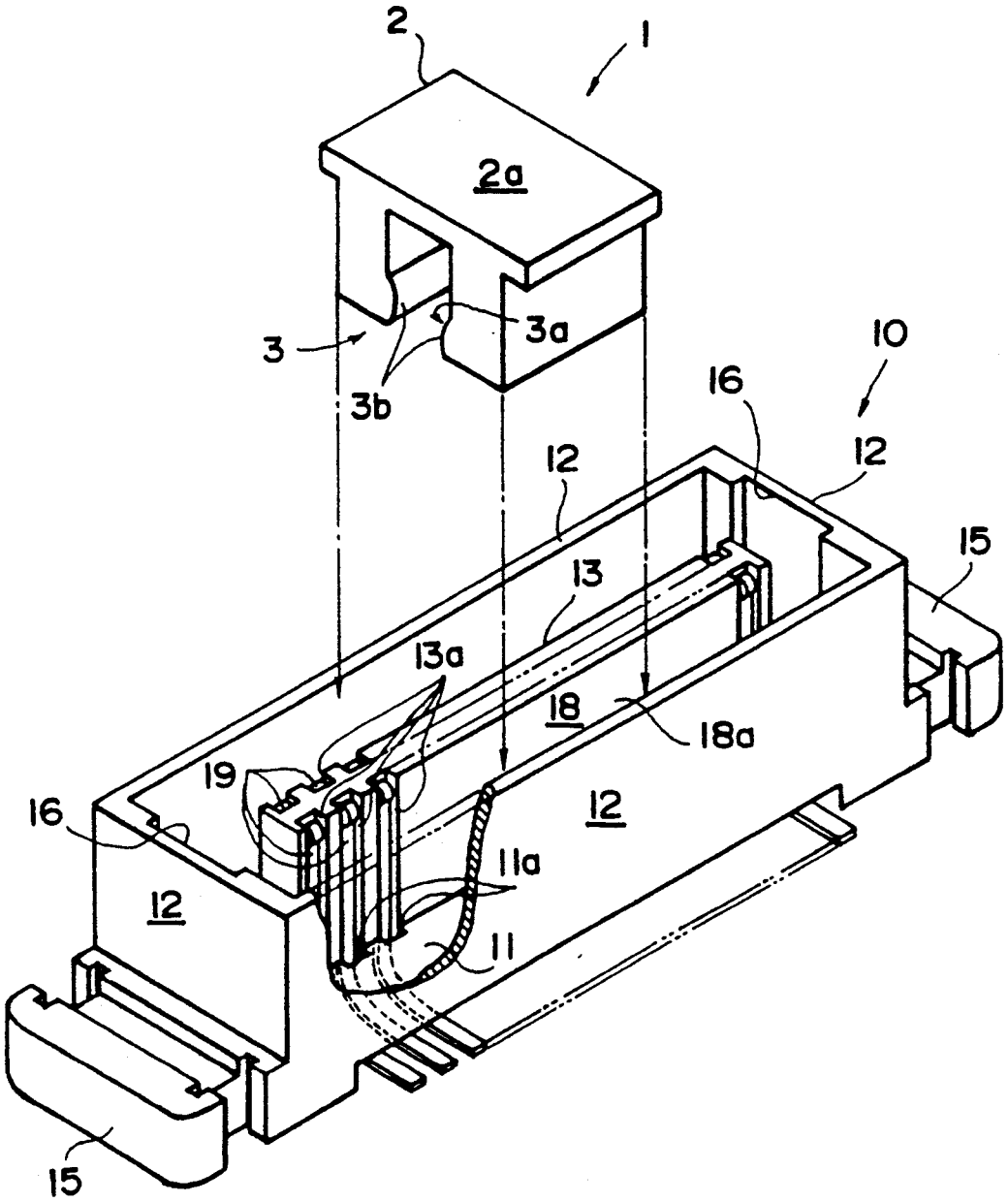
FIG. 1 is a partly exploded perspective view of a first embodiment of the invention.

As shown in FIG. 1, a conventional plug connector 10 for connection to a circuit board by a circuit-mount technique, comprises a rectangular, flat, horizontally extending, plate-like base wall 11 from all four respective sides of which thin, plate-like side walls 12 upstand, defining a mating cavity 18 having an opening 18*a* at the mating face and a mating rib structure 13 upstanding, centrally of the cavity, from the base wall.

It should be noted that the rib 13 is lower than the upper ends of the side walls 12.

Mounting portions 15, for mounting the connector 10 to a circuit board (not shown) extend from both longitudinal ends of the base wall 11.

Figure 4:
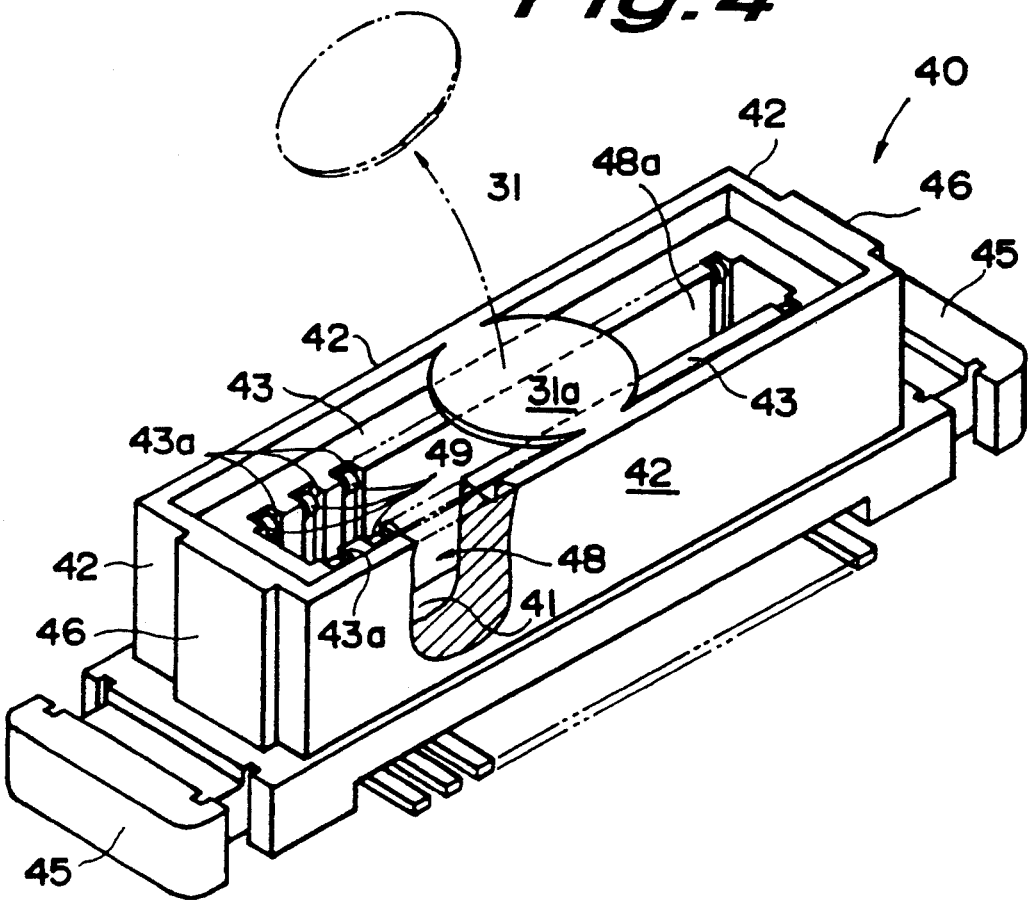
FIG. 4 is a perspective view, partly cut away, of a third embodiment of the invention.
Figure 5:
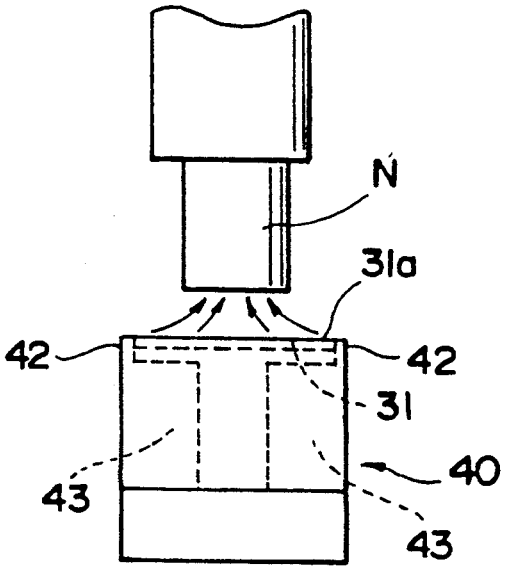
FIG. 5 is an end elevation of the third embodiment with the nozzle of a vacuum-type pick and place tool aligned therewith; and, FIG. 6 is a perspective view of a fourth embodiment of the invention.

Guiding grooves 16 are formed in respective opposite end walls 12 extending away from the mating face for guiding engagement with complementary ribs of the mating receptacle, for example, as show in FIG. 4.

Rows of contact receiving grooves 13*a* are formed in respective opposite sides of the rib 13 extending away from the mating face and communicating at lower ends with respective contact admitting apertures 11*a* formed in the base wall in alignment therewith. Contacts 19 for electrical connection with corresponding receptacle contacts on mating, extend from a recess under the base wall 11, through respective apertures 11*a* and are retained in grooves 13*a*.

It will be appreciated that, as the cavity opening 18*a* extends longitudinally beyond the periphery of a conventional suction nozzle mouth, and that the side walls are relatively thin, adherence of the top of the connector thereto cannot be obtained.

A cap member 1 for permitting adhesion is molded in one piece of plastic material and comprises a flat, rectangular plate portion 2 from a lower surface of which legs 3 depend. An upper surface 2*a* of the plate 2 has sufficient area and smoothness for adhesion by suction to the nozzle. The external width or span of the legs is substantially equal to the separation of the internal surfaces of longitudinally extending side walls 12 and the legs define between them a plug connector receiving space 3*a*. Connector gripping feet 3*b* are formed on inside surfaces of lower ends of respective legs and protrude towards each other for gripping engagement with the rib.

Figure 2:
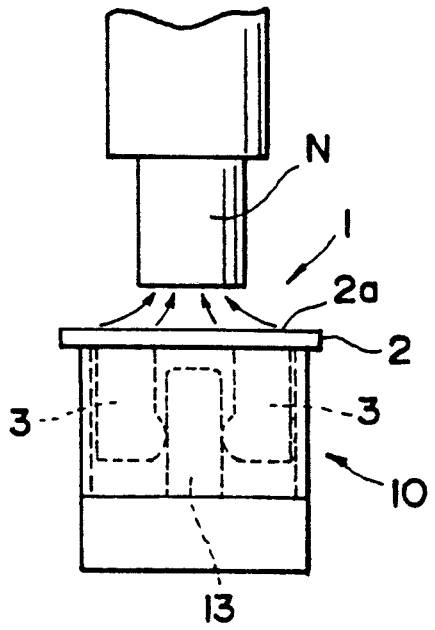
FIG. 2 is an end elevation of the first embodiment with the nozzle of a vacuum-type pick and place tool aligned therewith.

In assembling the cover-type cap member with the connector, the cap member is inserted, legs first into the cavity so that the legs straddle and grip the rib between them, as shown in FIG. 2, with the insertion movement being arrested by end portions of plate portion 2, which protrude beyond the legs, abutting upper ends of respective longitudinally extending side walls at the mating face so that only a central portion of the opening 18*a* is covered by the flat plate portion 2.

As the upper surface 2*a* of the plate portion can adhere by suction to an adhesion nozzle, the assembly can be carried thereby to a specific mounting position on a circuit board.

After the plug connector 10 has been carried into position on the circuit board and connected thereto by solder reflow, the cap member 1 can easily be removed therefrom, exposing the entire cavity for mating with a receptacle connector and freeing the cap member for reuse.

Figure 3:
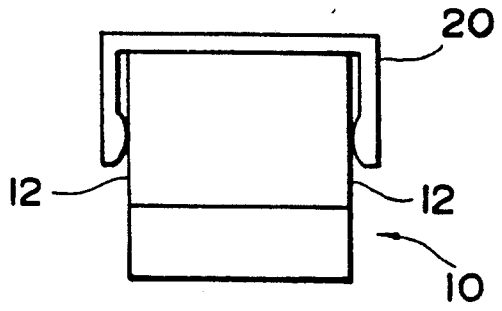
FIG. 3 is an end elevation of a second embodiment of the invention.

A second embodiment of cap member shown in FIG. 3, differs from the first embodiment in that the legs depend from extreme outer edge portions of the plate portion for gripping engagement with outer surfaces of respective longitudinal side walls 12.

It should be noted that, according to a modification, one or more legs may depend from a central location of the cap member defining a pluggable portion (somewhat similar to the rib 13 in the plug connector 10), enabling the cap member to be mated with a receptacle connector.

As shown in FIG. 4, an adherable type receptacle connector according to a third example of the invention, comprises a main receptacle body molded of plastic material with a flat, rectangular plate-like base wall 41, from all four sides of which upstand thin, plate-like side walls 42 rebated adjacent their upper ends, forming an internal, peripheral shoulder 43 complementary in height to the rib 13 of a plug connector. External board mounting portions 45, extend longitudinally from respective opposite ends of the base wall 41. Vertically extending guide ribs 46 are formed in endmost walls 12 for guiding engagement with complementary ribs of a plug connector during mating. Two, longitudinally extending rows of downwardly extending contact receiving grooves 43*a* are formed on respective inner surface of respective longitudinal side walls 42 communicating with the shoulder 43 and with respective contact admitting apertures (not shown) formed in the base wall 41 in alignment therewith. Contacts 49 for electrical connection with respective contacts of a plug connector (FIG. 1) extend through the respective apertures from a recess underneath the base wall 11 and are retained in respective grooves 41*a*.

As will be appreciated, the cavity opening 48*a* is of greater longitudinal extent than the correspondent dimension of the mouth of a conventional pick and place vacuum-type tool with the result that adherence of the top of the connector thereto by suction is not possible. However, a flat, disk-like portion 31 is integrally joined at diametrically opposite circumferencial locations by severable portions with uppermost ends of longitudinal side walls and provides an upwardly facing surface 31 of sufficient area and smoothness for adherence by suction to nozzle N of a conventional pick and place tool, enabling the connector to be carried thereby to a specific mounting location on a circuit board.

After the receptacle connector is adhered to the circuit board, the diametrically opposite portions are severed exposing the opening 48*a* for receiving a mating plug connector.

The invention is not limited to a disk-shaped portion providing a surface adherable by a suction but such surface may also be provided by a suitable portion of rectangular shape. In addition, a plug connector also be integrally formed with a portion providing a surface adherable by suction.

Figure 6:
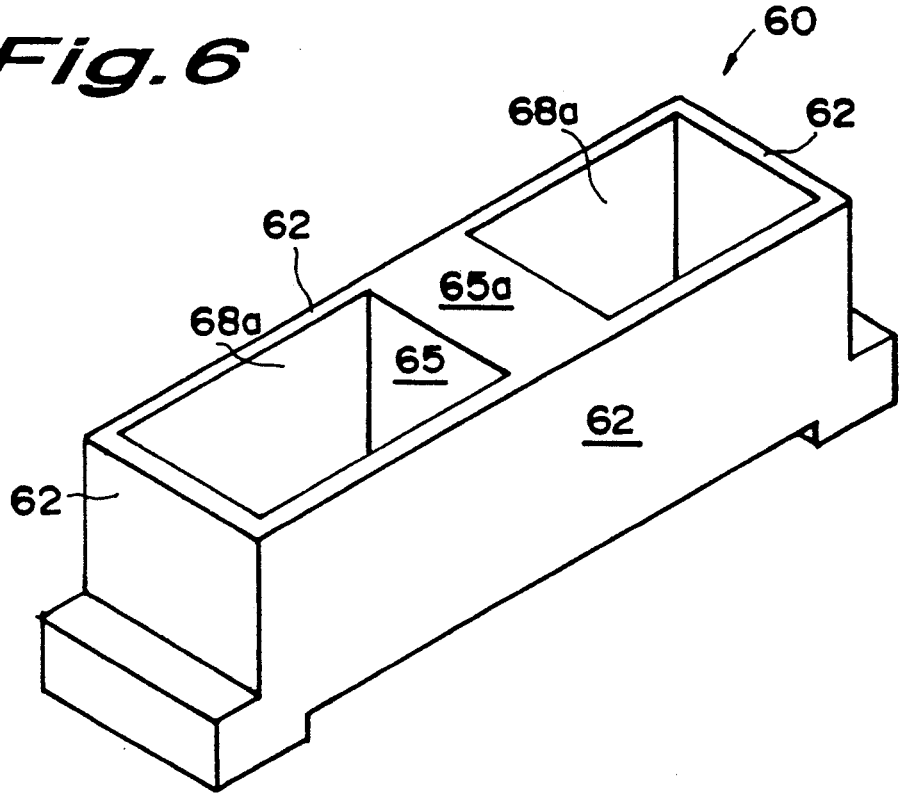

In another embodiment shown schematically in FIG. 6, an adherable surface is provided by an upper surface of a partition 65 formed either in a plug or in a receptacle connector and which divides the cavity defined by the side walls 62 into two longitudinally spaced portions thereby providing two mating openings 68*a* at the mating face. In this embodiment, the partition 65 is permanent and cannot be removed.

We claim:

1. An electrical connector assembly of the surface mount type for carrying into position on a circuit board by a conventional, suction applying tool comprising an insulating housing having a lower, circuit board engaging face and an upper, mating face, side walls upstanding from the circuit board engaging face and defining an elongate mating cavity opening to the mating face and being greater in length than a corresponding dimension of a mouth of a suction nozzle of the tool, means defining a surface engageable in covering relation with the nozzle mouth for adherence thereto by suction and having a length less than the length of the cavity opening and resilient means depending from the adherable surface into the cavity and resiliently engaging the side walls for releasably attaching the adherable surface means to the connector to extend across the mating face thereof with portions of the cavity opening to the mating face on each side of the adherable surface means.

2. An electrical connector assembly of the surface mount type for carrying into position on a circuit board by a conventional, suction applying tool comprising an insulating housing having a lower, circuit board engaging face and an upper, mating face, side walls upstanding from the circuit board engaging face and defining opposite longitudinal sides of an elongate mating cavity opening to the mating face and being greater in length than a corresponding dimension of a mouth of a suction nozzle of the tool, a rib extending centrally along the cavity away from the mating face, means defining a surface engageable in covering relation with the nozzle mouth for adherence thereto by suction and having a length less than the length of the cavity opening and a pair of resilient legs depending in side-by-side relation from the adherable surface means and releasably gripping the rib between them, for releasably attaching the adherable surface means to the connector to extend across the mating face thereof with portions of the cavity opening to the mating face on each side of the adherable surface means.

3. An electrical connector assembly of the surface mount type for carrying into position on a circuit board by a conventional, suction applying tool comprising an insulating housing having a lower, circuit board engaging face and an upper, mating face, side walls upstanding from the circuit board engaging face and defining opposite longitudinal sides of an elongate mating cavity opening to the mating face and being greater in length than a corresponding dimension of a mouth of a suction nozzle of the tool, means defining a surface engageable in covering relation with the nozzle mouth for adherence thereto by suction and having a length less than the length of the cavity opening and a pair of resilient legs depending in side-by-side relation from the adherable surface means for releasable gripping engagement with outer surface portions of respective side walls for releasably attaching the adherable surface means to the connector to extend across the mating face thereof with portions of the cavity opening to the mating face on each side of the adherable surface means.

* * * * *

UNITED STATES PATENT AND TRADEMARK OFFICE

CERTIFICATE OF CORRECTION

PATENT NO. : 5,249,977

DATED : October 5, 1993

INVENTOR(S) : Mitsuho Tanaka, et al

It is certified that error appears in the above-indentified patent and that said Letters Patent is hereby corrected as shown below:

On title page, item [73] after "Tokyo" the following should be inserted

--Fuji Machine Manufacturing Co., Ltd., Aichi-ken--

Signed and Sealed this

Twenty-second Day of March, 1994

*Attest:*

Bruce Lehman

BRUCE LEHMAN

*Attesting Officer*

*Commissioner of Patents and Trademarks*